US005225878A

United States Patent [19]

Asano et al.

[11] Patent Number: 5,225,878

[45] Date of Patent: Jul. 6, 1993

[54] IMAGE FORMING APPARATUS

[75] Inventors: Masaki Asano, Amagasaki; Shuji Iino, Hirakata; Akihito Ikegawa, Sakai; Izumi Osawa, Ikeda, all of Japan

[73] Assignee: Minolta Camera Kabushiki Kaisha, Osaka, Japan

[21] Appl. No.: 947,295

[22] Filed: Sep. 18, 1992

[30] Foreign Application Priority Data

Sep. 25, 1991 [JP] Japan ..... 3-243892

[51] Int. Cl.[5] ..... G03G 15/02

[52] U.S. Cl. ..... 355/219; 361/220; 361/221; 361/225

[58] Field of Search ..... 355/219, 200; 361/220, 361/221, 225

[56] References Cited

U.S. PATENT DOCUMENTS

| | | | |
|---|---|---|---|
| 3,146,385 | 8/1964 | Carlson | 317/262 |
| 4,336,565 | 6/1982 | Murray et al. | 361/225 |
| 4,383,752 | 5/1983 | Kisler | 361/225 X |
| 4,457,615 | 7/1984 | Seanor | 355/219 |
| 4,547,060 | 10/1985 | Lindblad | 355/219 |
| 4,555,171 | 11/1985 | Clouthier et al. | 361/225 X |
| 4,706,320 | 11/1987 | Swift | 355/219 X |
| 4,761,709 | 8/1988 | Ewing et al. | 361/225 |
| 4,825,334 | 4/1989 | Kisler | 361/225 X |
| 5,003,350 | 3/1991 | Yui et al. | 355/219 X |
| 5,012,282 | 4/1991 | Wanou et al. | 355/219 |
| 5,060,016 | 10/1991 | Wanou et al. | 355/219 |

FOREIGN PATENT DOCUMENTS

| | | |
|---|---|---|
| 62-164357 | 10/1987 | Japan . |
| 64-23266 | 1/1989 | Japan . |

*Primary Examiner*—A. T. Grimley
*Assistant Examiner*—Matthew S. Smith
*Attorney, Agent, or Firm*—Willian Brinks Olds Hofer Gilson & Lione

[57] ABSTRACT

An image forming apparatus includes a latent image carrier having a movable surface, and a stationary contact brush charger for electrostatically charging the surface of the latent image carrier in contact therewith during a movement of the carrier surface relative to the brush charger. In this apparatus, the contact time t, during which any arbitrarily chosen point on the carrier surface then moving in one direction is held in contact with the brush charger, and the electric resistance R of each of the brush bristles forming the brush charger are chosen such that the product of the contact time t multiplied by the common logarithm of the electric resistance R, i.e., ($t \times \log_{10} R$), is within the range of 0.9 to 4.6.

7 Claims, 6 Drawing Sheets

IMAGE FORMING APPARATUS

CROSS-REFERENCE TO THE RELATED APPLICATIONS

U.S. Ser. No. 07/697,425, filed May 9, 1991, and entitled "Image Forming Method and Apparatus"; U.S. Ser. No. 07/808,618, filed Dec. 17, 1991, and entitled "Image Forming Apparatus"; and U.S. Ser. No. 07/842,925, filed Feb. 27, 1992, and entitled "Contact Charging Device", all assigned to the same assignee of the present invention.

BACKGROUND OF THE INVENTION

1. Field of the Invention

The present invention generally relates to an electrophotographic image forming apparatus such as, for example, a copying machine and a printer. More particularly, the present invention relates to the electrophotographic image forming apparatus wherein an electrostatic latent image is formed on a surface of an electrostatic latent image carrier supported for movement in one direction after the carrier surface has been electrostatically charged by a stationary brush charger and has subsequently been exposed to imagewise rays of light, and is then developed into a visible powder image which is in turn transferred onto a recording medium.

2. Description of the Prior Art

In the well-known electrophotographic image forming apparatus such as, for example, an electrophotographic copying machine or an electrophotographic printer, a surface of an electrostatic latent image carrier is electrostatically charged prior to the formation of an electrostatic latent image thereon by exposure to imagewise rays of light. The electrostatic latent image is subsequently developed into a visible powder image which is in turn transferred onto a recording sheet. The powder image transferred onto the recording sheet is permanently fixed thereon to provide a copy as the recording sheet bearing the powder image is transported through a fixing unit.

As an electrostatic charger for developing the electrostatic charge on the surface of the latent image carrier, a corona charger and a contact brush charger are well known to those skilled in the art. Of them, the contact brush charger has recently received much attention partly because the contact brush charger would not deteriorate the carrier surface and partly because, as compared with the corona charger, the contact brush charger generates a minimized quantity of ozone which is generally recognized toxic to human being. While the contact brush charger is available in various models, the stationary contact brush charger which is supported fixedly relative to the movable latent image carrier has gained wide acceptable because of a simplified structure as compared with the rotary contact brush charger which is supported for rotation relative to the latent image carrier.

The contact brush charger, however, has its own peculiar problem in that the potential of the electrostatic charge built up on the surface of the latent image carrier tends to vary from place to place over the surface of the latent image carrier, constituting a cause of an appearance of line noises on the resultant image bearing copy.

Various attempts have hitherto been made to avoid the variation in potential of the electrostatic charge built up on the surface of the latent image carrier. For example, the Japanese Laid-open Patent Publication No. 64-23266, published Jan. 25, 1989, addresses to the contact time over which any arbitrarily chosen point on the surface of the latent image carrier is held in contact with an electroconductive brush forming the stationary contact brush charger. According to this publication, in order to avoid the varying potential of the electrostatic charge built up on the surface of the latent image carrier, the width of the electroconductive brush as measured in a direction transverse to the direction of movement of the surface of the latent image carrier and in a direction conforming to the widthwise direction of the latent image carrier is so chosen that any arbitrarily chosen point on the surface of the latent image carrier being moved contacts the electroconductive brush for a predetermined contact time not shorter than 0.1 second.

We have, however, found that, where the surface of the latent image carrier is electrostatically charged by the stationary contact brush charger, the electrostatic charging is accomplished through three closely related mechanisms of discharge, injection and friction during the contact taking place between the stationary contact brush charger and the surface of the latent image carrier. Of these mechanisms, the friction participates in the electrostatic charging to a negligible extent, but the discharge and the injection participate to a large extent. The electrostatic charging by discharge and injection is affected not only by the contact time, i.e., the duration of contact, between the electroconductive brush of the stationary contact brush charger and any arbitrarily chosen point on the surface of the latent image carrier, but also by the electric resistance exhibited by the electroconductive brush. This will now be discussed in further detail.

In the first place, how the contact time t affects the electrostatic charging by discharge and injection will be discussed. If the electroconductive brush forming a part of the stationary contact brush charger has a relatively small width and/or if the velocity of movement of the latent image carrier is high, the contact time t is naturally short. Referring now to FIG. 14, if the stationary contact brush charger has a relatively small width WD, brush bristles F are apt to break up, to form biases or to be disordered in any way during the image forming process to such an extent as to eventually result in a varying distribution of the electrostatic charge built up on the surface of the latent image carrier. This is also true even where the width WD is relatively large, provided that the velocity of movement of the surface of the latent image carrier is relatively high. An occurrence of such a disorder of the brush bristles F is considerable with an increase in number of copies or prints having been made.

On the other hand, if the stationary contact brush charger has a relatively large width and/or if the velocity of movement of the surface of the latent image carrier is relatively low, the contact time t is naturally long. Too long contact time t tends to result in a smudging of the brush bristles F such as adherence of toner fragments, particles ground off from the latent image carrier and/or paper dust to the brush bristles F, particularly tips thereof, as shown in FIG. 15 and, in the worst case it may occur, the bristle tips would entirely be covered up. The brush bristles F are similarly smudged locally when a cleaning unit used to remove residue toner from the surface of the latent image carrier is distorted.

In any event, such a smudging of the brush bristles lowers the efficiency of charge injection accomplished by the stationary contact brush charger. Once this occurs, a relatively large difference in amount of electrostatic charge built up on the latent image carrier is created between a portion of the surface of the latent image carrier, which has been held in contact with a smudged portion of the brush bristles where the efficiency of charge injection was lowered, and a less smudged portion of the surface of the latent image carrier which has been held in contact with a portion of the brush bristles where the efficiency of charge injection was high, resulting in a varying distribution of the electrostatic charge on the surface of the latent image carrier.

By the reason discussed above, it does not appear that the use of the long contact time between the contact brush charger and the surface of the latent image carrier such as suggested in the Japanese Laid-open Patent Publication No. 64-23266 is an effective solution to eliminate the varying distribution of the electrostatic charge on the surface of the latent image carrier. A combination of the width of the stationary contact brush charger and the velocity of movement of the surface of the latent image carrier, that is, the magnitude of the contact time t between the surface of the latent image carrier and the stationary contact brush charger, affects the pattern of distribution of the electrostatic charge built up on the surface of the latent image carrier.

We will now discuss how the electric resistance (hereinafter referred to as bristle electric resistance) of the brush bristles affect the pattern of distribution of the electrostatic charge on the surface of the latent image carrier. If the electric resistance R of each of the brush bristles, that is, the bristle electric resistance R, is too low, the resistance of the brush bristles F as a whole increases as the brush bristles F are smudged, and the increased resistance considerably affects the characteristic of electrostatic charge built up according to Paschen's law. For this reason, that portion of the surface of the latent image carrier which has been held in contact with the smudged portion of the brush bristles exhibits a lower surface potential than that exhibited by the portion thereof which has been held in contact with the less smudged portion of the brush bristles, resulting in a varying pattern of distribution of the electrostatic charge on the surface of the latent image carrier.

On the other hand, if the bristle electric resistance R is too high, a varying resistance at different portions of the brush bristles brings about an unnegligible influence on the built-up of the electrostatic charge by discharge. More specifically, even though the brush bristles are rated to have a volume resistivity of, for example, $10^6$ Ω/cm, manufacturing circumstances makes the actual volume resistivity vary from $10^5$ to $10^7$ Ω/cm. Since the stationary contact brush charger includes the contact brush having a flock of some hundred thousand bristles, the variation in volume resistivity cannot be negligible. Specifically, at a region of the contact brush having a relatively high bristle electric resistance R, the variation of the volume resistivity in a magnitude of plus or minus one figure with respect to the rated value acts considerably on a voltage drop, resulting in that respective portions of the contact brush having the relatively high and low bristle electric resistance R tend to be charged to high and low values, respectively. This in turn result in a varying pattern of distribution of the electrostatic charge built up on the surface of the latent image carrier.

As hereinabove discussed, the electrostatic charging by discharge and injection depends on the contact time t and the bristle electric resistance R of each bristle forming the brush of the stationary contact brush charger and, therefore, unless a proper value is chosen for each of the contact time t and the bristle electric resistance R, the surface of the latent image carrier cannot be electrostatically charged to a potential enough to avoid a varying distribution of the electrostatic charge thereon. Also, where the environment dependency (for example, the dependency on temperature and/or moisture) after the image forming which has taken place for a long time is desired to be minimized, the contact time t and the bristle electric resistance R should receive much attention.

SUMMARY OF THE INVENTION

In view of the foregoing, the present invention is intended to provide an improved image forming apparatus wherein the contact time t between the surface of the latent image carrier and the stationary contact brush charger and the bristle electric resistance R are properly chosen to minimize the environment dependency for a substantially prolonged period of time and also to provide a favorable pattern of electrostatic charge on the surface of the latent image carrier, thereby enabling the image forming apparatus to provide high quality image recordings.

The present invention is based on our finding that a favorable charging performance can be obtained if the contact time t and the bristle electric resistance R are so chosen as to have a relationship of ($t \times Log_{10}R$).

More specifically, the image forming apparatus to which the present invention is applicable comprises a latent image carrier having a movable surface, a stationary contact brush charger for electrostatically charging the surface of the latent image carrier in contact therewith during a movement of the surface of the latent image carrier relative to the stationary contact brush charger, means for projecting imagewise rays of light onto the electrostatically charged surface of the latent image carrier to form an electrostatic latent image thereon, a developing unit for developing the electrostatic latent image into a visible powder image, means for transferring the visible powder image onto a recording sheet. In this apparatus, when the contact time t, that is, the duration during which any arbitrarily chosen point on the surface of the latent image carrier then moving in one direction is held in contact with the stationary contact brush charger, is measured in terms of second and the bristle electric resistance R, that is, the electric resistance of each of the brush bristles forming the stationary contact brush charger, is expressed by Ω/cm, the product of the contact time t times the bristle electric resistance R, i.e., ($t \times \log_{10}R$), is chosen to be within the range of 0.9 to 4.6, preferably within the range of 1.5 to 4.1.

If the value of the ($t \times \log_{10}R$) is smaller than 0.9 or greater than 4.6, an unnegligible variation in distribution of the electrostatic charge results in on the surface of the latent image carrier.

The stationary contact brush charger which can be employed in the practice of the present invention may be of any known structure disclosed in, for example, U.S. Pat. No. 3,146,385 or the Japanese Laid-open Utility Model Publication No. 62-164357. According to this U.S. patent, brush bristles are retained by means of a clamp member.

The contract brush disclosed in this Japanese Utility Model publication is shown in FIG. 2 in a schematic exploded view. Referring to FIG. 2, the contact brush includes a generally rectangular backing fabric 201 having one of its opposite surfaces formed with an electroconductive coating and the other of the surfaces formed with a flock of brush bristles 200 in the form of electroconductive fibers piled to the backing fabric 201. The backing fabric 201 having the brush bristles 200 is in turn bonded to a similarly rectangular electroconductive support base 204 by means of a non-electroconductive double-sided adhesive strip 202. To establish an electric connection between the brush bristles 200 and the support base 204, a portion of the double-sided adhesive strip 202 is removed to define an opening in which an electroconductive material 203 is disposed such that the brush bristles 200 connected electrically together through the electroconductive coating are in turn electrically connected with the base support 204 through the electroconductive material 203.

Other than those listed above, the contact brush employable in the present invention may be of a construction as shown in FIGS. 3 and 4. The contract brush shown in FIGS. 3 and 4 includes a backing fabric 22 having a predetermined thickness T and having warp yarns 22*a* piled with electroconductive fibers 21 in a generally W-shaped fashion as shown in FIG. 4(*a*) or in a generally V-shaped fashion as shown in FIG. 4(*b*) to provide brush bristles 21 of a generally uniform height H. A surface of the backing fabric 22 opposite to the piled brush bristles 21 is coated with an electroconductive bonding material to avoid a fall-off of the electroconductive fibers and, hence, the brush bristles 21 from the backing fabric 22. After the application of the electroconductive bonding material, the backing fabric 22 having the brush bristles 21 is cut to a generally rectangular shape having a length L and a width W and is then bonded by the use of a suitable bonding agent or a double-sided adhesive tape to a generally rectangular electroconductive support base 23 made of, for example, aluminum.

Regardless of the particular structure of the contact brush, the brush bristles that can be employed in the stationary contact brush charger used in the present invention may be of any suitable material, provided that the electric resistivity, the flexibility, the hardness, the shape and the physical strength thereof are so suitably selected in consideration of the chargeability of the latent image carrier, the surface hardness of the latent image carrier, the diameter thereof, the positional relationship thereof with other elements and a system velocity that the application of an alternating current, a direct current or a voltage obtained by superimposing the alternating current with the direct current to the contact brush may result in a desired distribution of the electrostatic charge on the surface of the latent image carrier. Therefore, material for the brush bristles may not be limited for the purpose of the present invention.

Electroconductive material may be metal wires of, for example, tungsten, stainles, gold, platinum, aluminum, iron or copper having their length and diameter adjusted properly.

Electroconductive resinous material may be fibers of, for example, rayon, nylon, acetate, copper ammonia, vinyliden, vinylon, fluorinated ethylene, promix, benzoate, polyurethane, polyethylene, polyvinyl chloride, polykurale, polynosics or polypropylene, dispersed with a resistance adjusting material such as, for example, carbon black, carbon fibers, powdery metal, metallic whiskers, metal oxides or semiconductor material. In such case, a suitable selection of the amount of the resistance adjusting material dispersed in the electroconductive resinous material can result in a desired resistance value. Instead of the dispersion, the resistance adjusting material may be coated to fiber surfaces.

The brush bristles may have any suitable cross-sectional shape, for example, round, oval, polygonal, flat, with or without wrinkles formed around each brush bristle, or of any shape easy to manufacture, provided that the chargeability will not be adversely affected.

Where the contract brush employed in the stationary contact brush charger in the practice of the present invention is of a construction disclosed and shown in the previously mentioned U.S. patent, the contact time t can be determined in the following manner.

Referring to FIG. 5, the latent image carrier is shown in the form of a photoreceptor drum PC. Where an arbitrarily chosen point on the outer peripheral surface of the photoreceptor drum PC then rotated in one direction contacts only one brush bristles as shown therein, the contact time t can be approximately expressed by the quotient of the diameter D of the brush bristle divided by the velocity v of movement of the arbitrarily chosen point on the outer peripheral surface of the photoreceptor drum PC, that is, $t \simeq D/v$. In such case, the value of $(t \times \log_{10} R)$ generally lies outside the range of 0.9 to 4.6.

On the other hand, where an arbitrarily chosen point on the outer peripheral surface of the photoreceptor drum PC then rotated in one direction contacts a plurality of brush bristles successively during the movement of the outer peripheral surface of the photoreceptor drum PC relative to the contact brush, the contact time t is defined as a duration from the timing at which the arbitrarily chosen point on the peripheral surface of the photoreceptor drum PC contacts one of the brush bristles on the most trailing side with respect to the direction of rotation of the photoreceptor drum PC up to the timing at which the arbitrarily chosen point on the peripheral surface of the photoreceptor drum PC contacts another one of the brush bristles on the most leading side with respect to the direction of rotation of the photoreceptor drum PC as shown in FIG. 6.

Where the contract brush employed in the stationary contact brush charger in the practice of the present invention is of a construction disclosed and shown in the previously mentioned Japanese Utility Mode publication or of a construction shown in and described with reference to FIGS. 3 and 4, the contact time t can be determined in a manner similar to that discussed with reference to FIG. 6. In such case, if the charged width, i.e., the width of an area electrostatically charged by the charging brush, is expressed by w, the contact time t may be the quotient of the width w divided by the velocity v of movement of the outer peripheral surface of the photoreceptor drum PC.

In the case where the stationary contact brush charger comprises a plurality of, for example, four, contact brushes as shown in FIG. 7, the contact time t may be defined as the sum of the individual contact times t1, t2, t3 and t4 as shown therein.

According to the present invention, the contact time t between the stationary contact brush charger and the surface of the latent image carrier and the electric resistance R of each brush bristle of the stationary contact brush charger are so chosen as to satisfy the relationship of $\{0.9 \leqq (t \times \log_{10} R) \leqq 4.6\}$ and, therefore, the potential of the surface of the latent image carrier can advantageously be stabilized with no varying distribution of the electrostatic charge, ensuring the formation of high-quality image recordings.

BRIEF DESCRIPTION OF THE DRAWINGS

This and other objects and features of the present invention will become clear from the following description taken in conjunction with a preferred embodiment thereof with reference to the accompanying drawings, in which like parts are designated by like reference numerals and in which.

DETAILED DESCRIPTION OF THE PREFERRED EMBODIMENT

Figure 1:
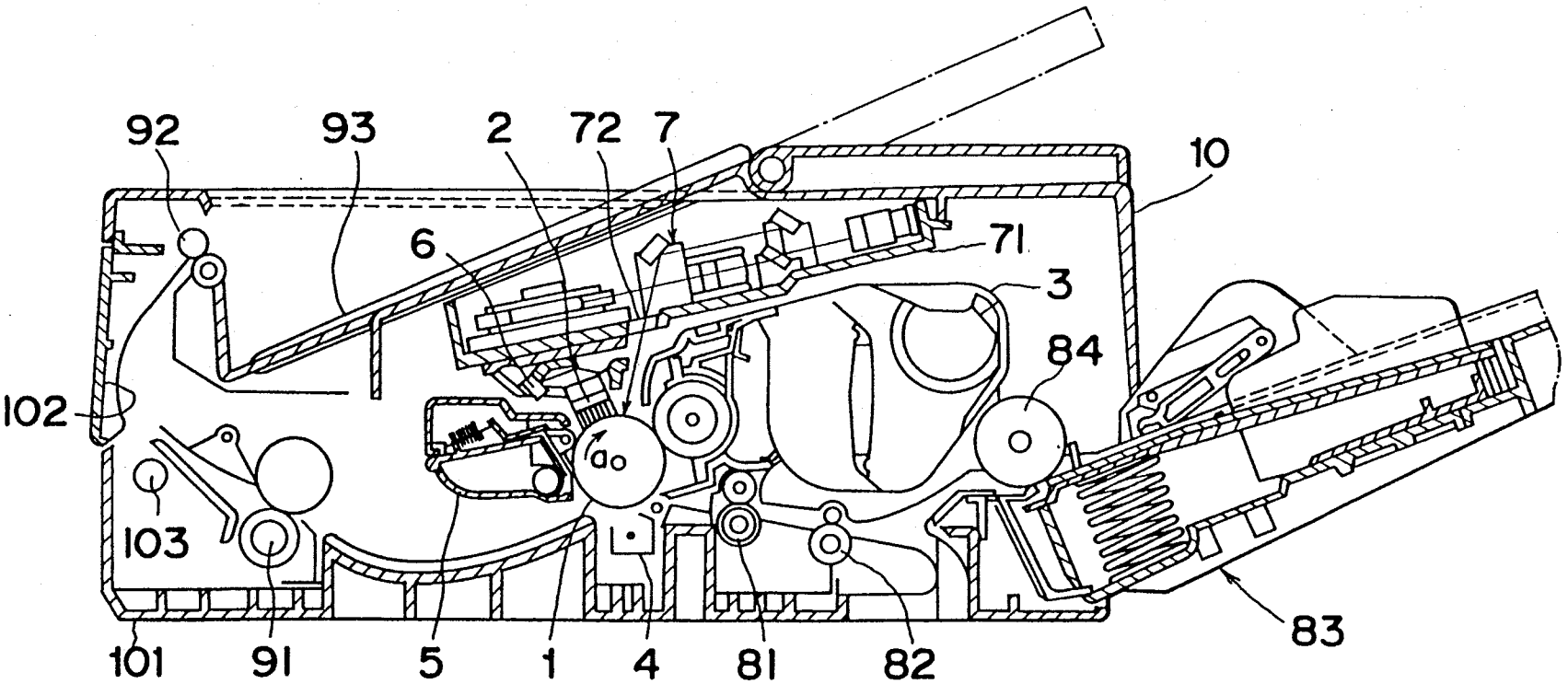
FIG. 1 is a schematic side sectional view of an electrophotographic printer embodying the present invention.

An electrophotographic printer to which the present invention is applicable is schematically shown in FIG. 1. Referring to FIG. 1, the printer includes a photoreceptor drum 1 supported within a printer housing 10 for rotation in one direction, for example, clockwise shown by the arrow a, driven by a suitable drive means (not shown). This printer also includes a stationary contact brush charger 2, a developing unit 3, a transfer charger 4, a cleaning unit 5 and an eraser unit 6, all disposed sequentially around the photoreceptor drum 1 so as to participate in a well-known electrophotographic copying process.

Positioned above the photoreceptor drum 1 within the printer housing is an optical system 7 including a semiconductor laser, a polygonal reflecting mirror assembly, a troidal lens, a semi-transparent mirror, a spherical mirror, a turn-up mirror, a reflecting mirror, etc., all accommodated within a casing 71. The casing 71 has a bottom formed with an exposure slit 72 defined therein so as to project imagewise rays of light therethrough towards the photoreceptor drum 1 along a passage delimited between the stationary contact brush charger 2 and the developing unit 3.

A timing roller pair 81, an intermediate roller pair 82 and a sheet supply cassette 83 are disposed generally sequentially to the right of the photoreceptor drum 1 as viewed in FIG. 1 with a sheet feed roller 84 positioned immediately above a leading end of the cassette 83 with respect to the direction of successive feed of recording sheets therefrom. On the other hand, a fixing roller pair 91 and a sheet discharge roller pair 92 are generally sequentially disposed to the left of the photoreceptor drum 1 with a sheet receiving tray 93 disposed in position to receive recording sheets discharged through the discharge roller pair 92.

The printer housing 10 comprises upper and lower housing units 101 and 102 which are hingedly connected together by means of a hinge pin 103 so that the upper housing unit 101 is pivotable relative to the lower housing unit 102 between opened and closed positions. The brush charger 2, the developing unit 3, the cleaning unit 5, the eraser unit 6, the optical system 7, an upper one of timing rollers forming the timing roller pair 81, an upper one of intermediate rollers forming the intermediate roller pair 82, the feed roller 84, an upper one of fixing rollers forming the fixing roller pair 91, the discharge roller 92 and the sheet receiving tray 93 are all accommodated in the upper housing unit 102. Therefore, when the upper housing unit 101 is pivoted about the hinge pin 103 to the opened position, servicing personnel is accessible to any one of various component parts within the printer housing 10 for servicing and/or cleaning purpose.

Figure 2:
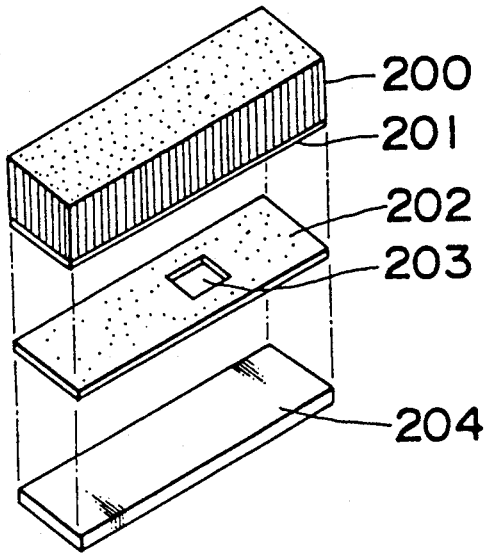
FIG. 2 is a schematic exploded view of one contact brush charger.
Figure 3:
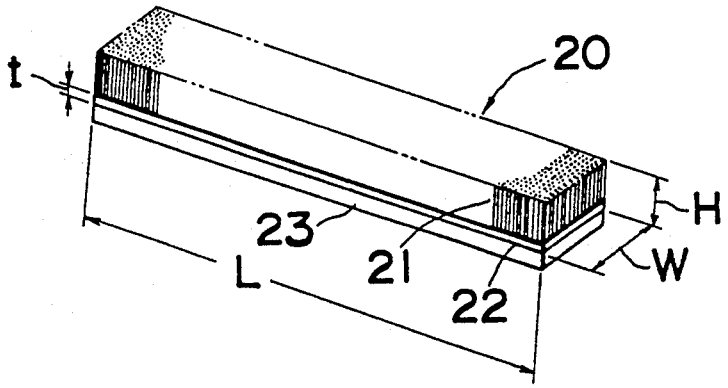
FIG. 3 is a schematic perspective view of another contact brush charger.
Figure 4A:
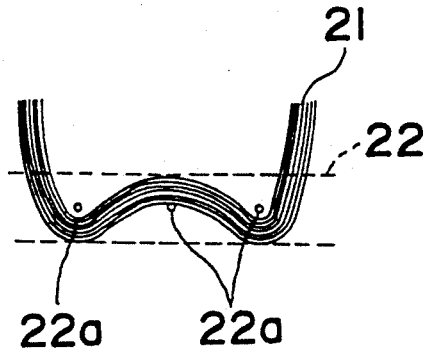
FIGS. 4(*a*) and 4(*b*) are schematic diagrams showing different manners in which fibers forming brush bristles of the contact brush charger of FIG. 3 are secured to a backing fabric.
Figure 4B:
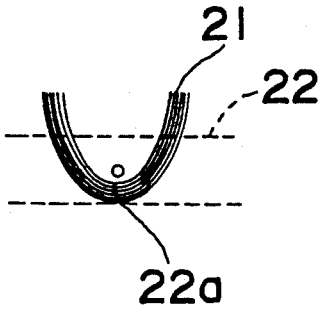
Figure 5:
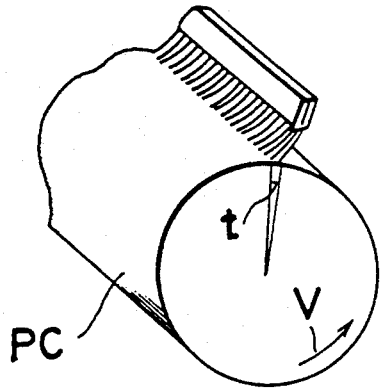
FIGS. 5 to 7 are schematic diagrams showing different manners of determining the contact time with different designs of the contact brush charger.
Figure 6:
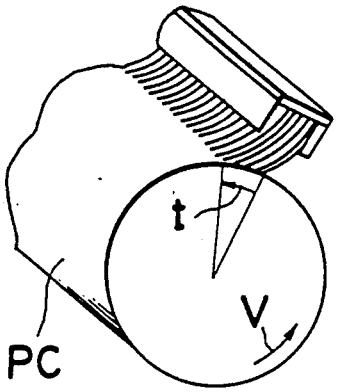
Figure 7:
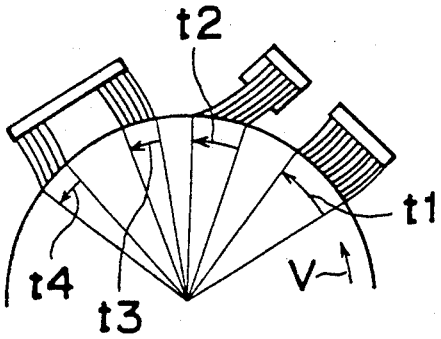
Figure 8A:
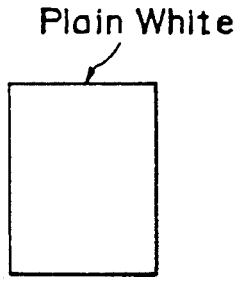
FIGS. 8(*a*) to 8(*d*) illustrates different print results used to evaluate the distribution of a potential at the surface of a photoreceptor drum.
Figure 8B:
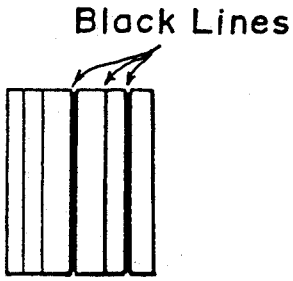
Figure 8C:
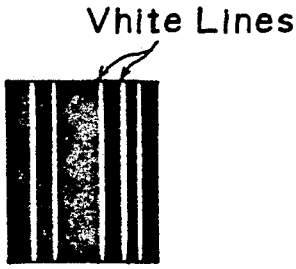
Figure 8D:
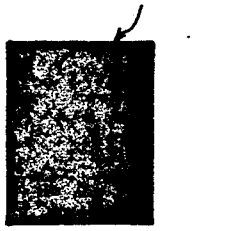

The stationary contact brush charger 2 shown therein is of a type employing the velveteen-like brush disclosed in the previously mentioned Japanese Utility Model publication and shown in FIG. 2. In the practice of the present invention, arrangement has been made to apply a developing bias from a source thereof (not shown) to the support base 204.

The photoreceptor drum 1 employed is of a type having a negative-chargeable, functionally separated organic photosensitive layer highly sensitive to rays of light of a long wavelength such as emitted by a semiconductor laser (780 nm) or a light emitting diode (680 nm).

This photoreceptor drum 1 was prepared in the following manner. 1 part by weight of $\tau$-metalless phthalocyanine, 2 parts by weight of polyvinyl butyral resin (3 mol % or less acetylated and 70 mol % butylated. Polymerization Degree: 1,000) and 100 parts by weight of tetrahydrofuran were charged into a pot of a ball mill and mixed for 24 hours so as to disperse uniformly, thereby providing a photosensitive paint having a viscosity of 15 cp at 20° C. The resultant photosensitive paint was painted by the use of a dipping method on an outer surface of a drum of 30 mm in outer diameter, 240 mm in length and 0.8 mm in wall thickness and was then dried for 30 minutes under a flow of air of 20° C. to complete a charge generating layer of 0.4 μm in film thickness. The drum used was of a type made of an aluminum allow containing 0.7 wt % of magnesium and 0.4 wt % of silicon.

Thereafter, 8 parts by weight of a hydrazone compound of the following chemical structure, 0.1 part by weight of orange pigment ("Sumiplast Orange 12" commercially available from Sumitomo Kagaku Kabushiki Kaisha of Japan), and 10 parts by weight of polycarbonate resin ("Panlite L-1250" commercially available from Teijin Kasei Kabushiki Kaisha of Japan) were dissolved into a solvent containing 180 parts by weight of tetrahydrofuran to give a paint having a viscosity of 240 cp at 20° C. This paint was then painted over the charge generating layer on the drum by the use of a dipping method and was dried for 30 minutes under the flow of air of 100° C. to form a charge transport layer of 28 μm in film thickness thereby to complete the photoreceptor drum 1.

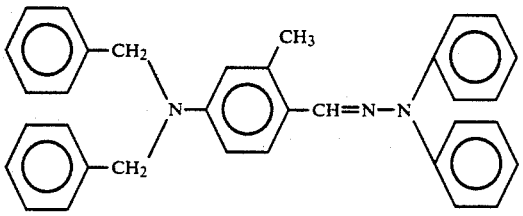

The τ-metalless phthalocyanine referred to above is of a kind which, when X-rays of 5418 in wavelength emitted from CuKα/Ni were employed, exhibited an X-ray diffraction pattern having a peak value at a Brag angle (2θ±0.2°) of 7.6, 9.2, 16.8, 17.4, 20.4 and 20.9 degrees. In particular, the phthalocyanine had an infrared absorption spectrum exhibiting four strongest absorption band at 751±2 $cm^{-1}$ within a region of 700 to 760 $cm^{-1}$, two comparably strongest absorption bands within a region of 1,320 to 1,340 $cm^{-1}$ and a characteristic absorption at 3,288±3 $cm^{-1}$.

In an image forming system utilizing rays of light of a long wavelength such as in a semiconductor laser optical system or a LED array system, the use of the photoreceptor having a sensitivity to the long wavelength suffices. However, the latent image carrier utilizable in the practice of the present invention may not be always limited thereto and may be selected suitably. By way of example, in the image forming system utilizing a light source of visible wavelength region such as, for example, a system utilizing a liquid crystal shutter array or a PLZT shutter array, or an analog image forming system utilizing light of visible wavelength and an optical system including lenses and mirrors, which is generally employed in standard copying machines, a photoreceptor having a sensitivity within the specific visible wavelength region may be employed.

Although the illustrated photoreceptor drum 1 is of a type having a functionally separated organic photosensitive layer wherein the charge transport layer is formed over the charge generating layer, the photoreceptor drum utilizable in the practice of the present invention may not be always limited thereto and may be of a type wherein the charge generating layer is formed over the charge transport layer or of a type capable of exhibiting both of a charge generating function and a charge transport function. A charge generating material, a charge transport material and a binder resin, all used in the practice of the present invention may be suitably selected from commercially available or well-known material.

Inorganic material such as, for example, zinc oxide, cadmium sulfide, a selenium alloy, or amorphous silicon alloy may also be employed.

The photoreceptor used in the practice of the present invention may have a surface protective layer for the purpose of improving the durability and the environmental resistance and may also have an undercoat for the purpose of improving the chargeability, the image quality and the bondability.

Material for the surface protective layer or the undercoat may include a resin such as, for example, a UV-curable resin, a resin curable at normal temperatures or a thermosetting resin, a mixed resin containing a resistance adjusting material dispersed into the above mentioned resin, a thin-film material such as, for example, metal oxide or metal sulfide, of a kind generally used in forming a thin film by the use of a vacuum vapor deposition technique or an ion plating technique, or an indefinite carbon film or an indefinite silicon carbide film both formed by the use of a plasma polymerization technique.

A base material for the photoreceptor may be of any suitable support material provided that a surface thereof has an electroconductive property and may be of any suitable shape, for example, cylindrical or flat, or in the form of a belt.

Also, a surface of the base may be roughened, oxidized and/or colored.

Toner used in the developing unit 3 is of a negative-chargeable type and was prepared in the following manner. A composition containing 100 parts by weight of bisphenol A-type polyester resin, 5 parts by weight of carbon black MA#8 (manufactured and sold by Mitsubishi Kasei Kogyo Kabushiki Kaisha of Japan), 3 parts by weight of BONTRON S-34 (manufactured and sold by Orient Kagaku Kogyo Kabushiki Kaisha of Japan), and 2.5 parts by weight of VISCOL TS-200 (manufactured and sold by Sanyo Kasei Kogyo Kabushiki Kaisha of Japan) was kneaded, pulverized and classified in a known manner to provide toner particles having an average particle size of 10 μm, 80 wt % of said toner particles having a particle size ranging from 7 to 13 μm. The resultant toner particles were subsequently added with 0.75 wt % of hydrophobic silica ("TANOLUX 500" manufactured by Talconen) as a fluidizing agent and the mixture was uniformly mixed by a homogenizer.

The resultant negative-chargeable, light impermeable, non-magnetizeable black toner material is charged into the developing unit 3 and is used to accomplish a reverse development by the application of a developing bias. It is, however, to be noted that the type of developing material and the developing system may not be always limited to those described above. In the practice of the present invention, any of positive-chargeable toner, light permeable toner and magnetizeable toner may be employed for the developing material and any of well-known two-component developing and normalization developing systems may also be employed. Also, the developing material may not be always limited to the black toner material, but a color toner material colored in yellow, magenta or cyan may also be employed.

The toner particles may have any suitable shape, for example, round, or may not be fixed in shape. Where a cleaning performance is desired to be enhanced, the toner material may have a lubricant such as, for example, polyvinylidene fluoride, mixed therein.

So far as the printer of the construction shown in FIG. 1 is employed, the surface of the photoreceptor drum 1 is electrostatically charged to a predetermined potential by the contact brush charger 2 and the electrostatic latent image is formed thereon when imagewise rays of light are projected onto the electrostatically charged surface area of the photoreceptor drum 1 through the optical system 7. The electrostatic latent image so formed is subsequently developed into a visible toner image by the developing unit 3, which is in turn transported to a transfer station where the transfer charger 4 is installed.

On the other hand, a recording sheet fed by the feed roller 84 outwardly from the sheet supply cassette 83 is transported towards the timing roller pair 81 through the intermediate roller pair 82 and is then towards the transfer station after having been synchronized with the arrival of the visible toner image on the photoreceptor drum 1 at the transfer station. The visible toner image is then transferred onto the recording sheet at the transfer station by the action of the transfer charger 4, and the recording sheet bearing the visible toner image is subsequently transported through the fixing roller pair 91. As the recording sheet passes through the fixing roller pair 91, the visible toner image on the recording sheet is permanently fixed thereon to provide a recorded print which is ejected onto the sheet receiving tray 93 by means of the discharge roller pair 92.

After the transfer of the visible toner image onto the recording sheet in the manner described above, the photoreceptor drum 1 continues to rotate past a cleaning station at which the cleaning unit 5 is installed. As the photoreceptor drum 1 moves past the cleaning station, residue toner material on the photoreceptor drum 1 is removed by the cleaning unit 5 and residue electrostatic charge on the photoreceptor drum 1 is erased by the erasing unit 6 in a known manner in readiness for the next succeeding cycle of copying operation.

For the purpose of evaluating a change in potential of the electrostatic charge built up on the surface of the photoreceptor drum 1 employed in the printer of the construction shown in FIG. 1, various Examples 1 to 31 and various Comparisons 1 to 10 were prepared in which different values were employed for each of the electric resistance R (Ω) and the contact time t (sec). Results of the evaluation are shown in Tables 1 to 8.

For the purpose of this evaluation, the contact time t is calculated by dividing the width (mm) of an area, electrostatically charged by the contact brush charger, by the peripheral velocity (mm/sec) of the photoreceptor drum 1.

The change in potential of the electrostatic charge built up on the surface of the photoreceptor drum 1 was evaluated in the following manner.

In the first place, the surface of the photoreceptor drum 1 was electrostatically charged in contact with the contact brush charger 2 to which a voltage of −1.2 KV was applied. While the optical system 7 for projecting the imagewise rays of light onto the surface of the photoreceptor drum 1 to form the electrostatic latent image was held in an inoperative position, a so-called plain white print sample as shown in FIG. 8(*a*) was prepared.

Then, with the developing bias potential increased gradually, discrete print samples were prepared until a print sample bearing a pattern of black lines as shown in FIG. 8(*b*) resulted in. The developing bias potential at which the print sample bearing the pattern of black lines as shown in FIG. 8(*b*) was obtained is expressed by $V_B$.

With the developing bias potential increased further, the black lines increased and a plain black print sample bearing a pattern of white lines as shown in FIG. 8(*c*) resulted in. The highest bias potential at which the pattern of white lines were left on the plain black print sample is expressed by $V_W$.

A continued increase of the developing bias potential in excess of the potential $V_W$ resulted in a plain black print sample as shown in FIG. 8(*d*).

Figure 9:
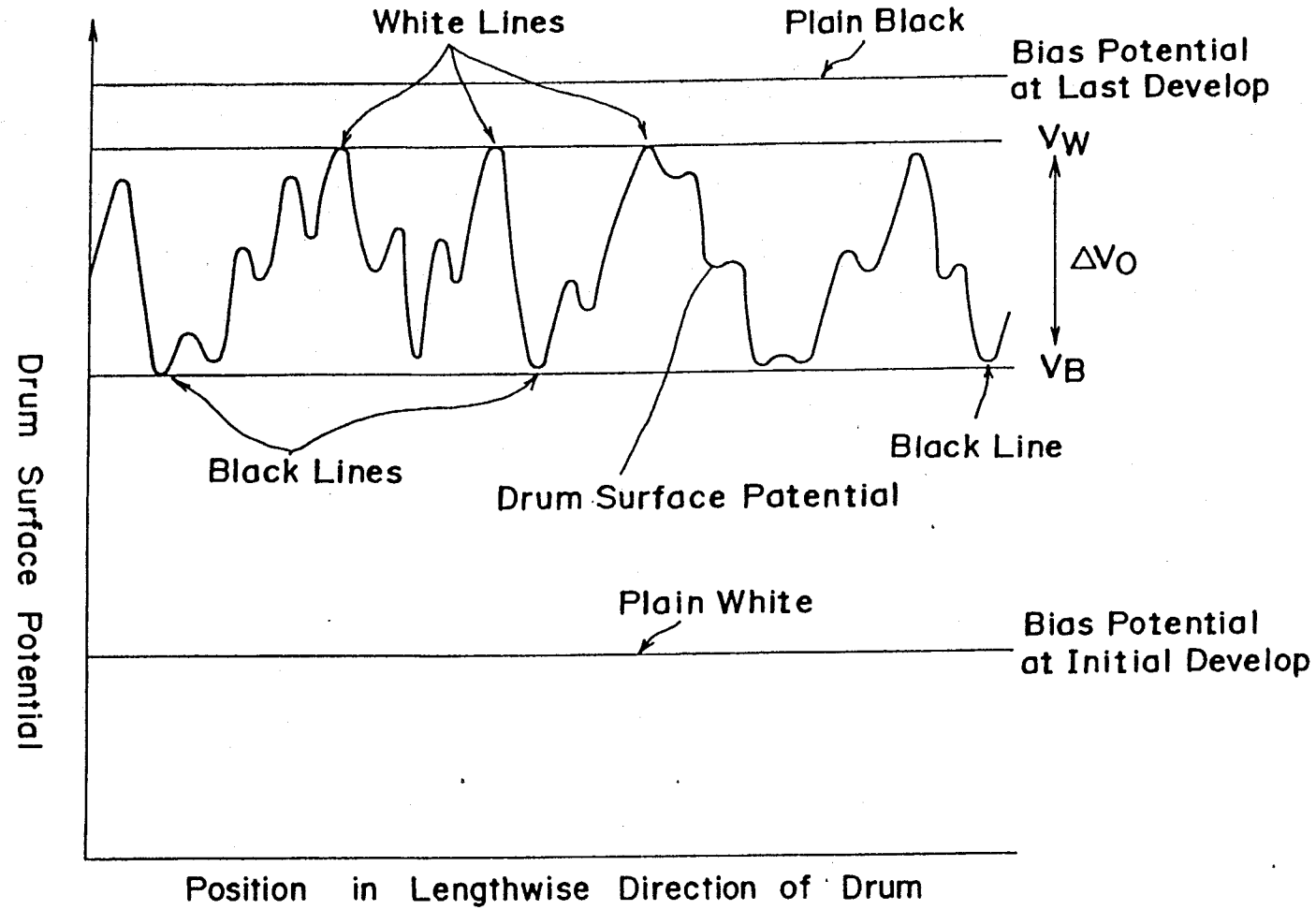
FIG. 9 is a graph showing a change in potential at the surface of the photoreceptor drum with a change in position in a direction lengthwise of the photoreceptor drum, which has resulted in the print results shown in FIG. 4.

The graph of FIG. 9 illustrates a variation in potential at the surface of the photoreceptor drum 1 which took place during the preparation of the various print samples shown in FIGS. 8(*a*) to 8(*d*), wherein the axis of ordinates represents the potential at the surface of the photoreceptor drum 1 and the axis of abscissas represents the position of the photoreceptor drum in a lengthwise direction thereof.

The difference between the potentials $V_B$ and $V_W$ is indicated by ΔVo and is descriptive of the magnitude of variation in potential of the electrostatic charge built up on the surface of the photoreceptor drum 1. As a matter of course, the smaller the potential difference ΔVo, the smaller the magnitude of variation in the potential of the electrostatic charge. In Tables 1 to 8, the potential difference ΔVo in each of Examples 1 to 31 and Comparisons 1 to 10, which was exhibited after the formation of 5,000 prints, is rated in terms of O, Δ and X which signify as follows.

Figure 10:
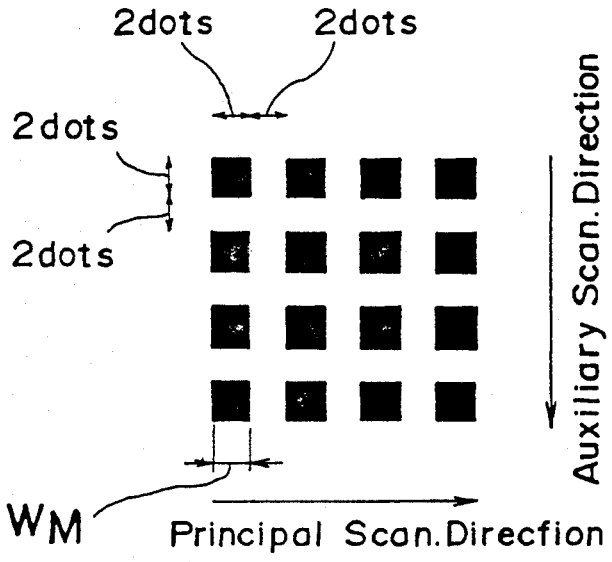
FIG. 10 is a schematic diagram showing a print sample used to evaluate a change in distribution of the potential at the surface of the photoreceptor drum.

The rating O is given when the potential difference ΔVo was equal to or smaller than 200 volt. In this rating, even when a print sample bearing a totally net-like pattern based on a 2 dots on and 2 dots off scheme as shown in FIG. 10 was prepared by the application of a bias potential of −250 volt, an extremely clear image could be obtained with no line-shaped image noise observed.

The rating Δ is given when the potential difference ΔVo was greater than 150 volt, but equal to or smaller than 200 volt. In this rating, in a print sample similar to that described above, a practically acceptable image could be obtained even though the presence of line-shaped image noises was more or less observed.

The rating X is given when the potential difference is greater than 200 volt. In this rating, in a print sample similar to that described above, a practically unacceptable image was obtained.

Figure 11:
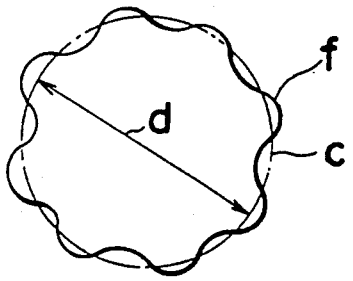
FIG. 11 is a diagram showing how the diameter of each brush bristle forming a part of the stationary contact brush charger is defined.
Figure 12:
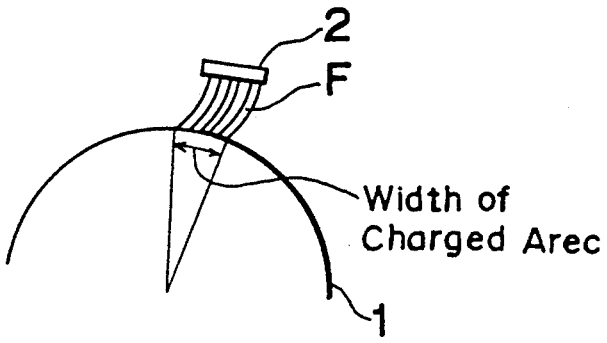
FIG. 12 is a schematic end view of the photoreceptor drum showing how a width of a charged area is defined.

In each of Tables 1 to 8, the length (mm) of each brush bristle forming the contact brush charger represents the length of the respective brush bristle measured when the contact brush of the contact brush charger was not held in contact with the surface of the photoreceptor drum, that is, the height of a brush portion, and the virtual diameter (μm) of each brush bristle represents the diameter d of the imaginary circle coaxial with the respective brush bristle f and having the area of surface equal to the cross-sectional surface area of the respective brush bristle f as shown in FIG. 11. The width of the charged area (mm) represents the length of that curved area of the surface of the photoreceptor drum 1 which is contacted by the brush bristles F as shown in FIG. 12.

With reference to Tables 1 to 8, the various Examples and Comparisons are commented.

Examples 1 to 8 and Comparisons 1 to 4 (See Table 1):

In these examples and comparisons, the width of the contact brush charger 2 having the velveteen-like brush was changed to vary the contact time t. By way of example, in Example 1, the width of the contact brush charger 2 and the amount of the brush pressed towards the photoreceptor drum 1 were so adjusted that the width of the charged area attained 3 mm. Each brush bristle was 5 mm in length and had an irregular cross-sectional shape as shown in FIG. 11, the virtual diameter of which was 20 μm.

Each brush bristles was a rayon fiber in which 10 wt % of electroconductive carbon was dispersed and having a volume resistivity of $1.00\times10^6$ Ω/cm at normal temperature and normal humidity (20° C. and 65%). To complete the contact brush, the electroconductive fibers were set in a density of 15,000 fibers per $cm^2$. The electric resistance R of each brush bristle calculated using the virtual diameter, the fiber length and the volume resistivity read $1.59\times10^{11}$ Ω.

On the other hand, the peripheral velocity of the photoreceptor drum was chosen to be 35 mm/sec and, in view of the width of the charged area being 3 mm, the contact time t was chosen to be 0.086 sec.

Results obtained by varying the width of the charged area from 1 to 16 mm and the contact time t from 0.029 to 0.457 in relation to the selected peripheral velocity of the photoreceptor drum are tabulated under Examples 1 to 8 and Comparison 1 to 4.

Table 1 indicates that the product of the contact time multiplied by the common logarithm of the electric resistance R, that is, $(t\times\log_{10}R)$, ranges from 0.32 to 5.12 and the potential difference ΔVo evaluated after the printing of 5,000 sheets was given the rating of O and Δ when the product $(t\times\log_{10}R)$ fell within the range of 0.9 to 4.6 and, in particular, the rating of O was given when the product $(t\times\log_{10}R)$ fell within the range of 1.5 to 4.1.

In each of Examples 1 to 8 and Comparison 1 to 4, the different values have been chosen for the contact time t. It will therefore be readily understood that too great the contact time t or too small the contact time t tends to result in an increase of the potential difference ΔVo by the reason hereinbefore discussed in connection with the electrostatic charging mechanisms.

Examples 9 to 14 and Comparisons 5 and 6 (See Table 2):

While in Examples 1 to 8 and Comparisons 1 to 4 the dependency of the contact time t on the width of the contact brush charger 2 has been evaluated, the dependency of the contact time t on the peripheral velocity of the photoreceptor drum is evaluated in each of Examples 9 to 14 and Comparisons 5 and 6.

Under the same conditions as in Example 5 except for the peripheral velocity of the photoreceptor drum, the contact time t was varied from 0.5 to 0.077 by varying the peripheral velocity of the photoreceptor drum from 20 to 130 mm/sec. At this time, the product $(t\times\log_{10}R)$ varied from 5.60 to 0.86.

Table 2 indicates that the potential difference ΔVo evaluated after the printing of 5,000 sheets was given the rating of O and Δ when the product $(t\times\log_{10}R)$ fell within the range of 0.9 to 4.6 and, in particular, the rating of O was given when the product $(t\times\log_{10}R)$ fell within the range of 1.5 to 4.1.

Summarizing Table 2, it is clear that, even though a favorable result was obtained with the use of the contact brush charger capable of giving the width of charged area of 10 mm as in Example 5, a change in peripheral velocity of the photoreceptor drum and, hence, a change in the product $(t\times\log_{10}R)$ to an improper value, results in an increase of the potential difference ΔVo by reason of the electrostatic charging mechanisms discussed hereinbefore in connection with the contact time t.

Examples 15 to 19 and Comparison 7 (See Table 3):

While in the foregoing examples and comparisons the change in the product $(t\times\log_{10}R)$ resulting from a change in contact time t was examined, a change in potential difference ΔVo with a change in electric resistance R is examined in each of Examples 15 to 19 and Comparison 7.

Under the same conditions as in Example 2 in which the potential difference ΔVo was rated Δ, but in which the amount of electroconductive carbon particles dispersed in the rayon fibers was varied to render them to exhibit a volume resistivity within the range of $10^2$ to $10^8$ Ω/cm, the change in potential difference ΔVo with a change in electric resistance R was examined. At this time, the electric resistance R varied from $1.59\times10^7$ to $1.59\times10^8$ Ω and product $(t\times\log_{10}R)$ varied from 0.82 to 1.51.

Table 3 indicates that the change in electric resistance R even though the contact time t is fixed results in the rating of O to X in potential difference ΔVo and that, when the product $(t\times\log_{10}R)$ was chosen to be a value not smaller than 0.9, favorable results in potential difference ΔVo could be obtained. This appears to have resulted in by reason of the electrostatic charging mechanisms discussed hereinbefore in connection with the electric resistance R.

Examples 20, 21 and 7 and Comparison 8 (See Table 4):

In a manner similar to the previous examples, and under the same conditions as in Example 7, but in which the volume resistivity was varied within the range of $10^5$ to $10^8$ Ω/cm, how the potential difference ΔVo is affected by a change in the product $(t\times\log_{10}R)$ was evaluated.

Table 4 indicates that, even though the contact time t is fixed, the control of the product $(t\times\log_{10}R)$ to a value not greater than 4.6 results in a favorable potential difference characteristic by reason of the electrostatic charging mechanisms discussed hereinbefore in connection with the electric resistance R.

Examples 9, 22 and 23 and Comparison 9 (See Table 5):

The electric resistance R varies not only with a change in volume resistivity of each brush bristle, but also with a change in sectional surface area of each brush bristle. In Examples 9, 22 and 23 and Comparison 9, the fiber (bristle) diameter was varied from 10 to 100 μm (For example, in Example 9, the fiber diameter is 20 μm.) to vary the product $(t\times\log_{10}R)$ to determine how the potential difference characteristic is affected.

Table 5 clearly shows that, so far as the product $(t\times\log_{10}R)$ is within the range claimed in the present invention, a favorable potential difference characteristic can be obtained.

Examples 9, 24 and 25 and Comparison 10 (See Table 6):

The electric resistance R of each bristle varies with a change in length of the respective bristle. In Examples 9, 24, and 25 and Comparison 10, the fiber (bristle) length was varied from 0.5 to 15 mm (For example, in Example 9, the fiber length is 5 mm.) to vary the product ($t \times \log_{10} R$) to determine how the potential difference characteristic is affected.

Table 6 clearly shows that, so far as the product ($t \times \log_{10} R$) is within the range claimed in the present invention, a favorable potential difference characteristic can be obtained.

Example 5 and 26 to 28 (See Table 7):

In Examples 5 and 26 to 28, the potential difference characteristic was evaluated using the contact brush chargers employing the contact brushes of different cross-sectional shapes, under the same condition as in Example 5.

Figure 13A:
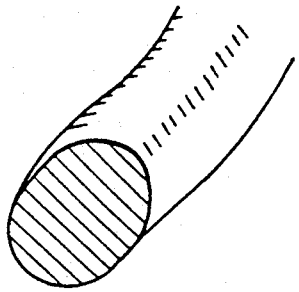
FIGS. 13(*a*) to 13(*c*) are schematic diagrams showing different cross-sectional shapes assumed by each brush bristle employeable in the practice of the present invention.
Figure 13B:
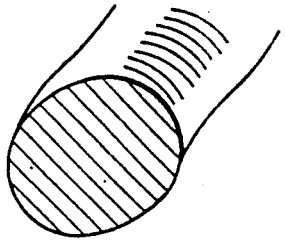
Figure 13C:
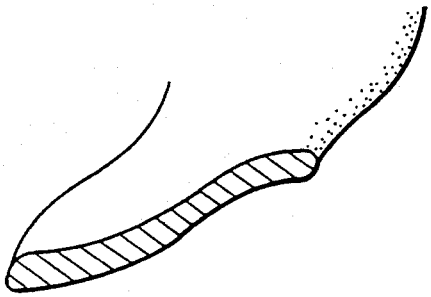
Figure 15:
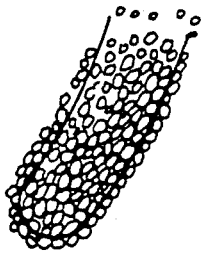
FIG. 15 is a schematic perspective view of a tip portion of the brush bristle showing a condition in which the brush is smudged.
Figure 14:
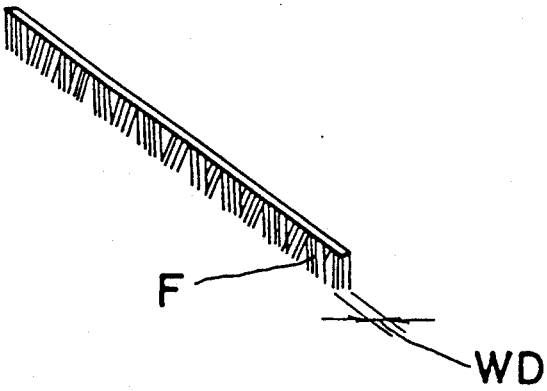
FIG. 14 is a schematic perspective view showing the contact brush used to explain the relationship between the width thereof and a varying pattern of distribution of the electrostatic charge built up on the surface of a latent image carrier.

While each brush bristle forming the contact brush charger employed in Example 5 had an irregular cross-sectional shape, each brush bristle forming the contact brush charger in Example 26 had a generally polygonal cross-sectional shape having, as shown in FIG. 13(*a*), a plurality of projections protruding radially outwardly; each brush bristle forming the contact brush charger in Example 27 had a generally round cross-sectional shape as shown in FIG. 13(*b*); and each brush bristle forming the contact brush charger in Example 28 had a generally flattened cross-sectional shape as shown in FIG. 13(*c*) wherein the ratio of the major axis relative to the minor axis was 10:1.

The different cross-sectional shapes of the brush bristles could be conditioned by varying the shape of a nozzle used during a fiber spinning. However, in Example 27, instead of the use of rayon as material for the brush bristles, nylon was employed due to ease to spin.

Table 7 clearly shows that the favorable potential difference characteristic could be obtained in all Examples and that, in view of the fact that a deviation in potential difference in all Examples fell within a tolerance, the favorable potential difference characteristic could be obtained regardless of the cross-sectional shape of the brush bristles used in the practice of the present invention.

Examples 5 and 29 to 31 (See Table 8):

In Examples 5 and 29 to 31, using a different density of the brush bristles employed in the contact brush charger, the potential difference characteristic was evaluated.

It is clear from Table 8 that, when the density of the brush bristles was chosen to be within the range of 10,000 to 30,000/cm$^2$, the favorable potential difference characteristic was obtained and that, since any deviation in potential difference in all Examples fell within a tolerance, the favorable potential difference characteristic could be obtained regardless of the density of the brush bristles, provided that the density is chosen to be at least within the range of 10,000 to 30,000/cm$^2$.

From the foregoing examples and comparisons, it can be concluded that the selection of a particular value for either one of the contact time t and the electric resistance R would not result in a stabilization of the potential difference characteristic, but it can be achieved only when the contact time t and the electric resistance R are so chosen as to result in a control of the product ($t \times \log_{10} R$) to a value within the range of 0.9 to 4.6.

With the present invention having fully been described in connection with the various embodiment thereof with reference to the accompanying drawings, it is to be noted that the present invention should not be construed as limiting to the particular examples and various changes and modifications are apparent to those skilled in the art. Such changes and modifications are to be understood as included within the scope of the present invention as defined by the appended claims, unless they depart therefrom.

TABLE 1

| | | Brush Bristle | | | | System | | | | | | | |
|---|---|---|---|---|---|---|---|---|---|---|---|---|---|
| | | Virtual | Sec. Sur. | Volume Resistivity | | Charged Area | Drum Surface | | | After 5,000 prints | | Fiber | Fiber |
| | Length (mm) | Dia. (μm) | Area (cm$^2$) | (Ω/cm) | R (Ω) | Width (mm) | Velocity (mm/sec) | t (sec) | $t \cdot \log_{10} R$ | Rating | ΔVo (V) | Density | Sectional Shape |
| Comp 1 | 5 | 20 | $3.14 \times 10^{-6}$ | $1.00 \times 10^6$ | $1.59 \times 10^{11}$ | 1 | 35 | 0.029 | 0.32 | X | 275 | 15,000 | Wrinkled round |
| Comp 2 | 5 | 20 | $3.14 \times 10^{-6}$ | $1.00 \times 10^6$ | $1.59 \times 10^{11}$ | 2 | 35 | 0.057 | 0.64 | X | 230 | 15,000 | Wrinkled round |
| Exam 1 | 5 | 20 | $3.14 \times 10^{-6}$ | $1.00 \times 10^6$ | $1.59 \times 10^{11}$ | 3 | 35 | 0.086 | 0.96 | Δ | 195 | 15,000 | Wrinkled round |
| Exam 2 | 5 | 20 | $3.14 \times 10^{-6}$ | $1.00 \times 10^6$ | $1.59 \times 10^{11}$ | 4 | 35 | 0.114 | 1.28 | Δ | 165 | 15,000 | Wrinkled round |
| Exam 3 | 5 | 20 | $3.14 \times 10^{-6}$ | $1.00 \times 10^6$ | $1.59 \times 10^{11}$ | 5 | 35 | 0.143 | 1.60 | ○ | 140 | 15,000 | Wrinkled round |
| Exam 4 | 5 | 20 | $3.14 \times 10^{-6}$ | $1.00 \times 10^6$ | $1.59 \times 10^{11}$ | 7 | 35 | 0.2 | 2.24 | ○ | 110 | 15,000 | Wrinkled round |
| Exam 5 | 5 | 20 | $3.14 \times 10^{-6}$ | $1.00 \times 10^6$ | $1.59 \times 10^{11}$ | 10 | 35 | 0.286 | 3.20 | ○ | 105 | 15,000 | Wrinkled round |
| Exam 6 | 5 | 20 | $3.14 \times 10^{-6}$ | $1.00 \times 10^6$ | $1.59 \times 10^{11}$ | 12 | 35 | 0.343 | 3.84 | ○ | 135 | 15,000 | Wrinkled round |
| Exam 7 | 5 | 20 | $3.14 \times 10^{-6}$ | $1.00 \times 10^6$ | $1.59 \times 10^{11}$ | 13 | 35 | 0.371 | 4.16 | Δ | 160 | 15,000 | Wrinkled round |
| Exam 8 | 5 | 20 | $3.14 \times 10^{-6}$ | $1.00 \times 10^6$ | $1.59 \times 10^{11}$ | 14 | 35 | 0.4 | 4.48 | Δ | 190 | 15,000 | Wrinkled round |
| Comp 3 | 5 | 20 | $3.14 \times 10^{-6}$ | $1.00 \times 10^6$ | $1.59 \times 10^{11}$ | 15 | 35 | 0.429 | 4.80 | X | 225 | 15,000 | Wrinkled round |
| Comp 4 | 5 | 20 | $3.14 \times 10^{-6}$ | $1.00 \times 10^6$ | $1.59 \times 10^{11}$ | 16 | 35 | 0.457 | 5.12 | X | 265 | 15,000 | Wrinkled round |

TABLE 2

| | Brush Bristle | | | | | System | | | | After 5,000 prints | | | |
|---|---|---|---|---|---|---|---|---|---|---|---|---|---|
| | Length (mm) | Virtual Dia. (μm) | Sec. Sur. Area ($cm^2$) | Volume Resistivity (Ω/cm) | R (Ω) | Charged Area Width (mm) | Drum Surface Velocity (mm/sec) | t (sec) | $t \cdot \log_{10}R$ | Rating | ΔVo (V) | Fiber Density | Fiber Sectional Shape |
| Comp 5 | 5 | 20 | $3.14 \times 10^{-6}$ | $1.00 \times 10^{6}$ | $1.59 \times 10^{11}$ | 10 | 20 | 0.5 | 5.60 | X | 340 | 15,000 | Wrinkled round |
| Exam 9 | 5 | 20 | $3.14 \times 10^{-6}$ | $1.00 \times 10^{6}$ | $1.59 \times 10^{11}$ | 10 | 25 | 0.4 | 4.48 | Δ | 190 | 15,000 | Wrinkled round |
| Exam 10 | 5 | 20 | $3.14 \times 10^{-6}$ | $1.00 \times 10^{6}$ | $1.59 \times 10^{11}$ | 10 | 30 | 0.333 | 3.73 | ○ | 130 | 15,000 | Wrinkled round |
| Exam 11 | 5 | 20 | $3.14 \times 10^{-6}$ | $1.00 \times 10^{6}$ | $1.59 \times 10^{11}$ | 10 | 40 | 0.25 | 2.80 | ○ | 100 | 15,000 | Wrinkled round |
| Exam 12 | 5 | 20 | $3.14 \times 10^{-6}$ | $1.00 \times 10^{6}$ | $1.59 \times 10^{11}$ | 10 | 70 | 0.143 | 1.60 | ○ | 140 | 15,000 | Wrinkled round |
| Exam 13 | 5 | 20 | $3.14 \times 10^{-6}$ | $1.00 \times 10^{6}$ | $1.59 \times 10^{11}$ | 10 | 100 | 0.1 | 1.12 | Δ | 180 | 15,000 | Wrinkled round |
| Exam 14 | 5 | 20 | $3.14 \times 10^{-6}$ | $1.00 \times 10^{6}$ | $1.59 \times 10^{11}$ | 10 | 120 | 0.083 | 0.93 | Δ | 200 | 15,000 | Wrinkled round |
| Comp 6 | 5 | 20 | $3.14 \times 10^{-6}$ | $1.00 \times 10^{6}$ | $1.59 \times 10^{11}$ | 10 | 130 | 0.077 | 0.86 | X | 205 | 15,000 | Wrinkled round |

TABLE 3

| | Brush Bristle | | | | | System | | | | After 5,000 prints | | | |
|---|---|---|---|---|---|---|---|---|---|---|---|---|---|
| | Length (mm) | Virtual Dia. (μm) | Sec. Sur. Area ($cm^2$) | Volume Resistivity (Ω/cm) | R (Ω) | Charged Area Width (mm) | Drum Surface Velocity (mm/sec) | t (sec) | $t \cdot \log_{10}R$ | Rating | ΔVo (V) | Fiber Density | Fiber Sectional Shape |
| Comp 7 | 5 | 20 | $3.14 \times 10^{-6}$ | $1.00 \times 10^{2}$ | $1.59 \times 10^{7}$ | 4 | 35 | 0.114 | 0.82 | X | 210 | 15,000 | Wrinkled round |
| Exam 15 | 5 | 20 | $3.14 \times 10^{-6}$ | $1.00 \times 10^{3}$ | $1.59 \times 10^{8}$ | 4 | 35 | 0.114 | 0.94 | Δ | 195 | 15,000 | Wrinkled round |
| Exam 16 | 5 | 20 | $3.14 \times 10^{-6}$ | $1.00 \times 10^{4}$ | $1.59 \times 10^{9}$ | 4 | 35 | 0.114 | 1.05 | Δ | 185 | 15,000 | Wrinkled round |
| Exam 17 | 5 | 20 | $3.14 \times 10^{-6}$ | $1.00 \times 10^{5}$ | $1.59 \times 10^{10}$ | 4 | 35 | 0.114 | 1.17 | Δ | 175 | 15,000 | Wrinkled round |
| Exam 2 | 5 | 20 | $3.14 \times 10^{-6}$ | $1.00 \times 10^{6}$ | $1.59 \times 10^{11}$ | 4 | 35 | 0.114 | 1.28 | Δ | 165 | 15,000 | Wrinkled round |
| Exam 18 | 5 | 20 | $3.14 \times 10^{-6}$ | $1.00 \times 10^{7}$ | $1.59 \times 10^{12}$ | 4 | 35 | 0.114 | 1.39 | Δ | 155 | 15,000 | Wrinkled round |
| Exam 19 | 5 | 20 | $3.14 \times 10^{-6}$ | $1.00 \times 10^{8}$ | $1.59 \times 10^{13}$ | 4 | 35 | 0.114 | 0.51 | ○ | 145 | 15,000 | Wrinkled round |

TABLE 4

| | Brush Bristle | | | | | System | | | | After 5,000 prints | | | |
|---|---|---|---|---|---|---|---|---|---|---|---|---|---|
| | Length (mm) | Virtual Dia. (μm) | Sec. Sur. Area ($cm^2$) | Volume Resistivity (Ω/cm) | R (Ω) | Charged Area Width (mm) | Drum Surface Velocity (mm/sec) | t (sec) | $t \cdot \log_{10}R$ | Rating | ΔVo (V) | Fiber Density | Fiber Sectional Shape |
| Exam 20 | 5 | 20 | $3.14 \times 10^{-6}$ | $1.00 \times 10^{5}$ | $1.59 \times 10^{10}$ | 13 | 35 | 0.371 | 3.79 | ○ | 130 | 15,000 | Wrinkled round |
| Exam 7 | 5 | 20 | $3.14 \times 10^{-6}$ | $1.00 \times 10^{6}$ | $1.59 \times 10^{11}$ | 13 | 35 | 0.371 | 4.16 | Δ | 160 | 15,000 | Wrinkled round |
| Exam 21 | 5 | 20 | $3.14 \times 10^{-6}$ | $1.00 \times 10^{7}$ | $1.59 \times 10^{12}$ | 13 | 35 | 0.371 | 4.53 | Δ | 195 | 15,000 | Wrinkled round |
| Comp 8 | 5 | 20 | $3.14 \times 10^{-6}$ | $1.00 \times 10^{8}$ | $1.59 \times 10^{13}$ | 13 | 35 | 0.371 | 4.90 | X | 235 | 15,000 | Wrinkled round |

TABLE 5

| | Brush Bristle | | | | | System | | | | After 5,000 prints | | | |
|---|---|---|---|---|---|---|---|---|---|---|---|---|---|
| | Length (mm) | Virtual Dia. (μm) | Sec. Sur. Area ($cm^2$) | Volume Resistivity (Ω/cm) | R (Ω) | Charged Area Width (mm) | Drum Surface Velocity (mm/sec) | t (sec) | $t \cdot \log_{10}R$ | Rating | ΔVo (V) | Fiber Density | Fiber Sectional Shape |
| Comp 9 | 5 | 10 | $7.85 \times 10^{-7}$ | $1.00 \times 10^{6}$ | $6.37 \times 10^{11}$ | 10 | 25 | 0.4 | 4.72 | X | 215 | 15,000 | Wrinkled round |
| Exam 9 | 5 | 20 | $3.14 \times 10^{-6}$ | $1.00 \times 10^{6}$ | $1.59 \times 10^{11}$ | 10 | 25 | 0.4 | 4.48 | Δ | 190 | 15,000 | Wrinkled round |
| Exam 22 | 5 | 50 | $1.96 \times 10^{-5}$ | $1.00 \times 10^{6}$ | $2.55 \times 10^{10}$ | 10 | 25 | 0.4 | 4.16 | Δ | 160 | 15,000 | Wrinkled round |
| Comp 23 | 5 | 100 | 7.85 × | $1.00 \times 10^{6}$ | $6.37 \times 10^{9}$ | 10 | 26 | 0.4 | 3.92 | ○ | 140 | 15,000 | Wrinkled |

TABLE 5-continued

| | Brush Bristle | | | | System | | | | After 5,000 prints | | | |
|---|---|---|---|---|---|---|---|---|---|---|---|---|
| Length (mm) | Virtual Dia. (μm) | Sec. Sur. Area ($cm^2$) | Volume Resistivity (Ω/cm) | R (Ω) | Charged Area Width (mm) | Drum Surface Velocity (mm/sec) | t (sec) | $t \cdot \log_{10}R$ | Rating | ΔVo (V) | Fiber Density | Fiber Sectional Shape |
| | | $10^{-5}$ | | | | | | | | | | round |

TABLE 6

| | Brush Bristle | | | | System | | | | After 5,000 prints | | | |
|---|---|---|---|---|---|---|---|---|---|---|---|---|
| Length (mm) | Virtual Dia. (μm) | Sec. Sur. Area ($cm^2$) | Volume Resistivity (Ω/cm) | R (Ω) | Charged Area Width (mm) | Drum Surface Velocity (mm/sec) | t (sec) | $t \cdot \log_{10}R$ | Rating | ΔVo (V) | Fiber Density | Fiber Sectional Shape |
| Exam 24 | 0.5 | 20 | $3.14 \times 10^{-6}$ | $1.00 \times 10^{6}$ | $1.59 \times 10^{10}$ | 10 | 25 | 0.4 | 4.08 | ○ | 215 | 15,000 | Wrinkled round |
| Exam 25 | 1 | 20 | $3.14 \times 10^{-6}$ | $1.00 \times 10^{6}$ | $3.18 \times 10^{10}$ | 10 | 25 | 0.4 | 4.20 | Δ | 190 | 15,000 | Wrinkled round |
| Exam 9 | 5 | 20 | $3.14 \times 10^{-6}$ | $1.00 \times 10^{6}$ | $1.59 \times 10^{11}$ | 10 | 25 | 0.4 | 4.48 | Δ | 160 | 15,000 | Wrinkled round |
| Comp 10 | 15 | 20 | $3.14 \times 10^{-6}$ | $1.00 \times 10^{6}$ | $4.77 \times 10^{11}$ | 10 | 25 | 0.4 | 4.67 | X | 140 | 15,000 | Wrinkled round |

TABLE 7

| | Brush Bristle | | | | System | | | | After 5,000 prints | | | |
|---|---|---|---|---|---|---|---|---|---|---|---|---|
| Length (mm) | Virtual Dia. (μm) | Sec. Sur. Area ($cm^2$) | Volume Resistivity (Ω/cm) | R (Ω) | Charged Area Width (mm) | Drum Surface Velocity (mm/sec) | t (sec) | $t \cdot \log_{10}R$ | Rating | ΔVo (V) | Fiber Density | Fiber Sectional Shape |
| Exam 5 | 5 | 20 | $3.14 \times 10^{-6}$ | $1.00 \times 10^{6}$ | $1.59 \times 10^{11}$ | 10 | 35 | 0.286 | 3.20 | ○ | 105 | 15,000 | Wrinkled round |
| Exam 26 | 5 | 20 | $3.14 \times 10^{-6}$ | $1.00 \times 10^{6}$ | $1.59 \times 10^{11}$ | 10 | 35 | 0.286 | 3.20 | ○ | 105 | 15,000 | Polygonal |
| Exam 27 | 5 | 20 | $3.14 \times 10^{-6}$ | $1.00 \times 10^{6}$ | $1.59 \times 10^{11}$ | 10 | 35 | 0.286 | 3.20 | ○ | 105 | 15,000 | Round |
| Exam 28 | 5 | 20 | $3.14 \times 10^{-6}$ | $1.00 \times 10^{6}$ | $1.59 \times 10^{11}$ | 10 | 35 | 0.286 | 3.20 | ○ | 110 | 15,000 | Flattened |

TABLE 8

| | Brush Bristle | | | | System | | | | After 5,000 prints | | | |
|---|---|---|---|---|---|---|---|---|---|---|---|---|
| Length (mm) | Virtual Dia. (μm) | Sec. Sur. Area ($cm^2$) | Volume Resistivity (Ω/cm) | R (Ω) | Charged Area Width (mm) | Drum Surface Velocity (mm/sec) | t (sec) | $t \cdot \log_{10}R$ | Rating | ΔVo (V) | Fiber Density | Fiber Sectional Shape |
| Exam 5 | 5 | 20 | $3.14 \times 10^{-6}$ | $1.00 \times 10^{6}$ | $1.59 \times 10^{11}$ | 10 | 35 | 0.286 | 3.20 | ○ | 105 | 15,000 | Wrinkled round |
| Exam 29 | 5 | 20 | $3.14 \times 10^{-6}$ | $1.00 \times 10^{6}$ | $1.59 \times 10^{11}$ | 10 | 35 | 0.286 | 3.20 | ○ | 110 | 10,000 | Wrinkled round |
| Exam 30 | 5 | 20 | $3.14 \times 10^{-6}$ | $1.00 \times 10^{6}$ | $1.59 \times 10^{11}$ | 10 | 35 | 0.286 | 3.20 | ○ | 110 | 20,000 | Wrinkled round |
| Exam 31 | 5 | 20 | $3.14 \times 10^{-6}$ | $1.00 \times 10^{6}$ | $1.59 \times 10^{11}$ | 10 | 35 | 0.286 | 3.20 | ○ | 105 | 30,000 | Wrinkled round |

What is claimed is:

1. An image forming apparatus which comprises:

a latent image carrier having a surface moving between a charging position and an image forming position at a speed of v (mm/sec);

a contact charger including at least one contact brush having a flock of brush bristles extending in a direction perpendicular to the direction of movement of the latent image carrier; and a moving means for moving the contact charger so as to contact the latent image carrier at the charging position in a predetermined contact width d (mm);

said latent image carrier being moved from the charging position towards the image forming position so as to satisfy the following relationship:

$$0.9 \leqq (t \times \log_{10}R) \leqq 4.6$$

wherein t (sec) represents d/v (sec) and R represents an electric resistance (Ω/cm) of each of the bristles forming the contact charger.

2. The image forming apparatus as claimed in claim 1, wherein said flock of brush bristles contacts the latent image carrier at the charging position at a plurality of locations.

3. The image forming apparatus as claimed in claim 1, wherein said speed of movement of the latent image carrier, v is within the range of 20 to 130 mm/sec.

4. The image forming apparatus as claimed in claim 1, wherein said electric resistance R is within the range of $10^2$ to $10^8$ Ω/cm.

5. The image forming apparatus as claimed in claim 4, wherein each of the brush bristles has a diameter within the range of 10 to 100 μm.

6. The image forming apparatus as claimed in claim 5, wherein each of the bristles has a length within the range of 0.5 to 15 mm.

7. The image forming apparatus as claimed in claim 6, wherein the brush bristles are formed in a density of 10,000 to 30,000 fibers per $cm^2$.

* * * * *

UNITED STATES PATENT AND TRADEMARK OFFICE

CERTIFICATE OF CORRECTION

PATENT NO. : 5,225,878

DATED July 6, 1993

INVENTOR(S) : Masaki Asano, et al.

It is certified that error appears in the above-indentified patent and that said Letters Patent is hereby corrected as shown below:

In col. 5, line 62, change "stainles" to --stainless--.

In col. 9, line 34, change "5418" to --5418--.

In col. 18, last line, in Table 5, in the column under the heading "Drum Surface Velocity (mm/sec)", change "26" to --25--.

In col. 20, line 65 (claim 3, line 3), after "carrier", delete "," (comma).

Signed and Sealed this

Third Day of May, 1994

Bruce Lehman

*Attest:*

BRUCE LEHMAN

*Attesting Officer*

*Commissioner of Patents and Trademarks*